United States Patent [19]

Poerschke

[11] Patent Number: 4,851,805

[45] Date of Patent: Jul. 25, 1989

[54] METHOD FOR THE PRODUCTION OF A SUB-MINIATURE FUSE AS WELL AS SUB-MINIATURE FUSE

[75] Inventor: Karl Poerschke, Sprockhövel, Fed. Rep. of Germany

[73] Assignee: Wickmann Werke GmbH, Witten, Fed. Rep. of Germany

[21] Appl. No.: 674,075

[22] Filed: Nov. 23, 1984

[30] Foreign Application Priority Data

Nov. 23, 1983 [DE] Fed. Rep. of Germany ..... 3342302

[51] Int. Cl.[4] ..... H01H 85/16

[52] U.S. Cl. ..... 337/231; 29/623; 29/418; 337/228; 337/253

[58] Field of Search ..... 29/623, 619, 613, 418; 337/190, 186, 201, 208, 213, 214, 228, 231, 236, 232, 251–253; 338/215, 271, 273, 274

[56] References Cited

U.S. PATENT DOCUMENTS

| | | | |
|---|---|---|---|
| 2,759,065 | 8/1956 | Moeller | 337/252 |
| 3,355,532 | 11/1967 | Bracht et al. | 29/613 |
| 4,326,185 | 4/1982 | Arikawa | 337/201 |

FOREIGN PATENT DOCUMENTS

| | | | |
|---|---|---|---|
| 971709 | 10/1964 | United Kingdom | 337/231 |

OTHER PUBLICATIONS

Kolb, Don J., "Designing Plastic Parts for Ultrasonic Assembly," Machine Design, Mar. 16, 1967, pp. 1–7.

*Primary Examiner*—P. W. Echols

*Attorney, Agent, or Firm*—Bruce L. Adams; Van C. Wilks

[57] ABSTRACT

The invention relates to a method for the production of a sub-miniature fuse, as well as to a sub-miniature fuse. Known casing with three chambers and a separate cover are difficult to manufacture and are prone to faults due to their complicated shape. According to the invention, an internally substantially smooth surface and externally cylindrical casing is formed, preferably from identical tube halves, whose end faces are closed either by correspondingly constructed connecting electrodes or by concomitantly shaped end walls, the electrodes always carrying the fuse wire on their inside and the connecting leads on their outside. Preference is given to the use of an intermediate member, which encloses the electrodes and the fuse wire fixed thereto. In each case production is simplified. There is also no need for shrink-on tubes for the insulation of contact caps.

12 Claims, 4 Drawing Sheets

FIG. 2
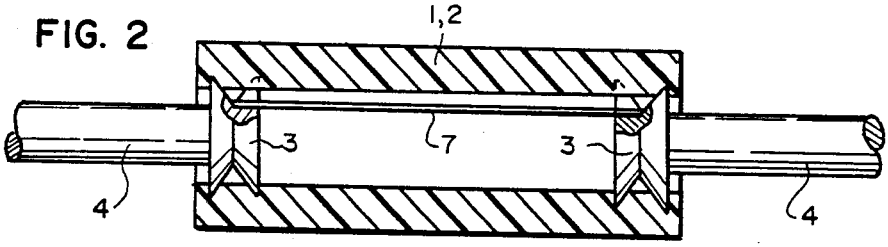
FIG. 3
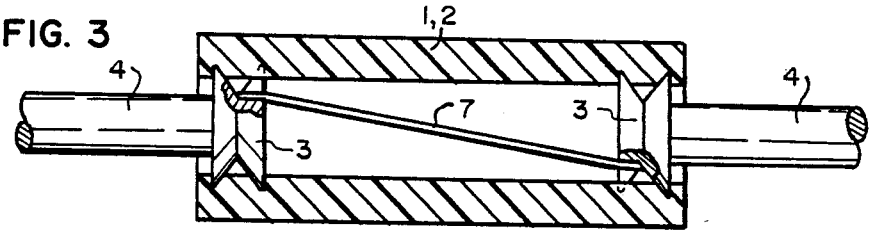
FIG. 4
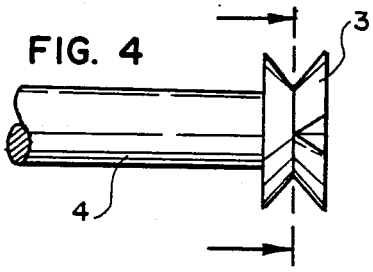
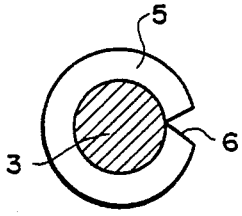
FIG. 7
FIG. 5
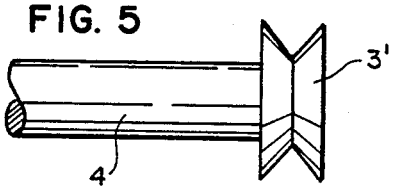
FIG. 6
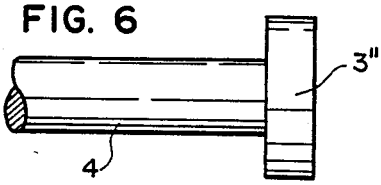

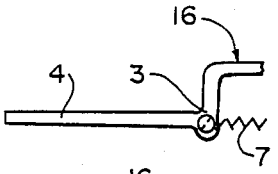
FIG. 9
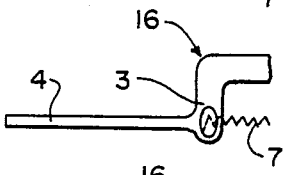
FIG. 10
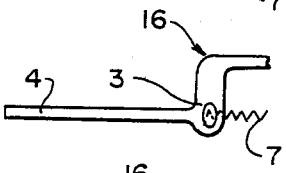
FIG. 11
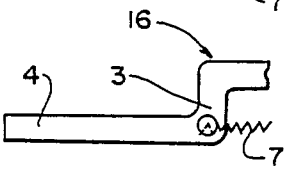
FIG. 12
FIG. 14
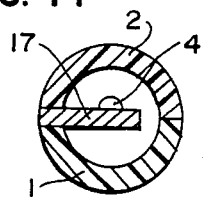
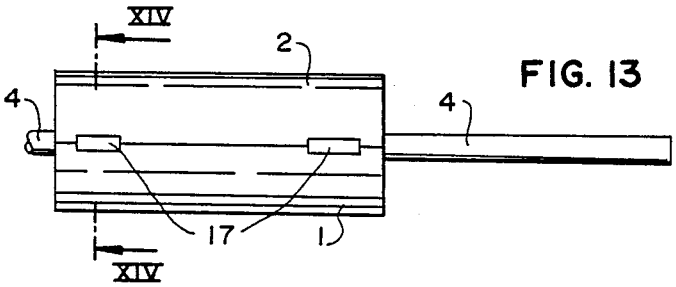
FIG. 13
FIG. 15
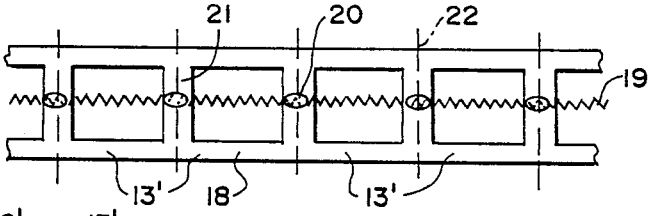
FIG. 16
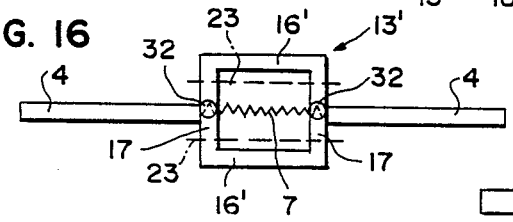
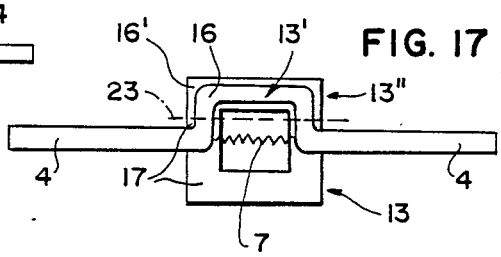
FIG. 17

METHOD FOR THE PRODUCTION OF A SUB-MINIATURE FUSE AS WELL AS SUB-MINIATURE FUSE

BACKGROUND OF THE INVENTION

The invention relates to a method for the production of a sub-miniature fuse, in which after fixing the distance between the two connecting electrodes, a fuse wire is electrically conductively fixed therebetween and subsequently an initially two-part casing surrounding the electrodes and the fuse wire is closed. The invention also relates to a sub-miniature fuse comprising a casing formed from two halves with the electrodes contained therein, connecting wire or lead ends being located on one side thereof, and a fuse wire fixed to the other side.

The heretofore known sub-miniature fuses, which are also called pico fuses, can be looked upon as a miniaturized version of a fuse of normal size of, e.g., length 20 mm. They comprise, e.g., a small ceramic tube, to which caps are adhered at either side and to which are in turn soldered the fuse wire located within the small ceramic tube, together with the connecting leads. A fuse of this type, which is approximately only 7 mm long and approximately 2.4 mm thick is still largely produced manually, so that the production costs are comparatively high. The reason for the mainly manual manufacture is the difficulty of handling the fuse wire, which in extreme cases has a diameter of only 8 $\mu$m.

In order to counteract these problems, attempts have already been made to subdivide the interior of a prismatic casing into three chambers and to reserve the two outer chambers for joining the fuse wire to the connecting leads, while the inner chamber is reserved for the fuse wire. In view of the small size of the components, this proposal is difficult to put into practice and it is also necessary to diverge from the heretofore conventional rotationally symmetrical construction.

SUMMARY OF THE INVENTION

The object of the present invention is therefore to provide a production method of the aforementioned type, together with a sub-miniature fuse, while using a very simple casing, whose production takes place without difficulty despite the smallness of the construction and in which the external shape of the sub-miniature fuse is substantially cylindrical and smooth.

According to the invention, this object is solved by a method in which, according to a first proposal, the casing has a substantially flat surface on the inside, the spaced electrodes are prefixed in one casing part and after fixing the fuse wire the casing is closed, accompanied by the final fixing of the electrodes to the inner surface.

According to a second, alternative proposal, the inside of the casing is given a substantially flat surface, the fuse wire is fixed between the spaced electrodes and the electrodes together with the fuse wire are placed in one casing part and then the second casing part is placed thereon for fixing the electrodes and the fuse wire and for closing the casing.

The aforementioned object with respect to a sub-miniature fuse is firstly solved in that the casing is tubular and its inside is given a substantially smooth surface throughout, while the electrodes close the end faces of the casing in plug-like manner.

Secondly and in an alternative manner with respect to the sub-miniature fuse, it is proposed that the casing is tubular and on its inside is constructed in substantially smooth-surfaced manner throughout and at both ends is closed, with the exception of a passage for the particular contact, while being provided on the inside near each end face of the casing with at least one arm oriented at a right angle to the longitudinal axis of the casing in its plane of division and optionally extending up to the outside of the casing and being connected to the contact of the said end face of the casing or forming one part with the said contact.

The sub-miniature fuse produced according to the aforementioned method externally has the configuration of a cylindrical body which, at its ends, has no thickened portions as a result of caps or the like and instead its end faces are closed either in the manner of a plug by the electrodes or by end walls, in each case with a passage for the electrodes. This leads to excellent conditions for the printing on of markings, without there being any need for a shrink-on sleeve or a powder covering. Thus, the fixed diameter limit can fully benefit the size of the casing, which indirectly facilitates production.

If the two casing parts are constructed as tube halves, they can be continuously cut to length, i.e. produced in such a way that the simplicity thereof could harldy be exceeded. In a thermal welding process for joining the two tube halves, a welding lip can be shaped onto one contact face. On closing the casing, the two tube halves can be placed upon one another in opposite directions, so that in each case a welding lip meets the smooth contact face without a welding lip.

The prefixing of final fixing of the electrodes within the casing halves, as well as the holding together of the actual casing can take place with the aid of an adhesive, or a joint is brought about by heating and in this case the casing material must be a thermo-plastic material. Ultrasonic heads, radiators or similar heat sources can be used for heating purposes and these are of the type conventionally used in bonding and embedding parts in thermoplastic materials. For better adhesion of the electrodes in the plastic material, the surface thereof can be roughened, e.g. sand-blasted or etched.

When closing the casing, account can be taken of the slight penetration of the electrodes into the inner surface of the tube half when the electrodes are used in plug form. In fact, this penetration of the electrodes improves the seating thereof in the casing and consequently the holding together of the sub-miniature fuse. If the surfaces of the electrodes facing the inner surfaces of the casing are constructed in an angular manner, this process is further facilitated. By means of all-round V-grooves, two or more all-round sharp edges can be obtained, between which there is adequate space for receiving the slightly squeezed plastic material.

As a result of the slight penetration of the electrodes into the inner surface of the casing, the fuse wire is not soldered externally to the periphery of the electrodes and is instead soldered more in the center, so that it is not sheared off during the closing of the casing. An adequately central fixing of the fuse wire is obtained if the sides of the electrodes facing the fuse wire are provided with a notch, which optionally extends up to the center of the electrode and permits an approximately central soldering of the fuse wire to each electrode.

A very substantial further development of the method according to the second proposal given hereinbefore is that for the spaced electrodes and for fixing the fuse wire thereto an intermediate member is formed, to which the fuse wire is electrically conductively fixed by both ends so as to span a loop, frame or bow-shaped extension of the intermediate member. The intermediate member, including the fuse wire and the electrodes constructed or fixed to the intermediate member are then arranged between the casing halves and the casing is closed.

In this solution, the intermediate member consequently forms a "lost device", which already interconnects the electrodes and the fuse wire and is arranged in the provided definite position between the casing halves, before they are permanently fixed together. As will be explained relative to a number of embodiments, the method according to the invention is further simplified as a result thereof.

It is advantageous if on either side of the opening of the casing halves, vanes project therefrom and approximately parallel to the plane of division and they are cut from the casing after closing the latter together with the not further used parts of the intermediate member located between the vanes and outside the casing. These vanes are formed during the production of the thermoplastic casing halves and within the scope of the invention they are used for centering the same, as well as for receiving the laterally projecting loop, frame or bow-shaped part of the intermediate member.

There are numerous procedures for producing the intermediate member. According to a first proposal according to the invention, a metal strip in the form of a ladder is formed, to whose rungs is electrically conductively fixed a fuse wire filament running at right angles over the same, after which the intermediate member is separated from the metal strip along the rungs and is provided with the electrodes. Thus, in this case rectangular, frame-like intermediate members are obtained. The fuse wire filament can be very easily fixed to the initially ladder-like metal strip without any significant wastage of expensive fuse wire material and then the intermediate members are individually separated from the strip. As soon as the electrodes have been soldered on either side, the intermediate member is ready for insertion in the casing halves.

According to an alternative of the invention, the intermediate member including the contacts can be formed from one piece of metal wire, which is given a bow-shaped extension, the fuse wire being electrically conductively fixed to the inner corners thereof, roughly in the extension of the outer metal wire ends. As a result of this bow-shaped or loop-shaped configuration of the intermediate member, the electrodes are automatically formed on the intermediate member. It is then only necessary to fix the fuse wire on the inner corners of the bow-shaped extension in such a way that it freely spans the latter and then the intermediate member is redy for insertion between the casing halves.

According to a second alternative for the production of the intermediate member, a mixed or combined form of the two aforementioned methods for producing the same is provided. According to this method variant, the intermediate member separated from the substantially ladder-shaped metal strip after fixing a fuse wire filament thereto is electrically conductively fixed and preferably welded to a second, substantially bow-shaped metal wire intermediate member, whose ends form the electrodes and so as to provide a combined intermediate member, the first two intermediate members then being placed upon one another. Thus, the combined effect of the two first-mentioned intermediate member forms are obtained.

The intermediate member can be wholly or partly flattened. The flattening effect leads to greater stability, the round wire form gives a simpler centering of the intermediate member between the casing halves. It is also possible to have a partial flattening.

According to this embodiment, the end faces of the casing halves are closed, with the exception of a recess for the passage of a contact. Semicircular end walls are used for this purpose and are shaped at the time of producing the casing halves.

BRIEF DESCRIPTION OF THE DRAWINGS

The invention is described in greater detail hereinafter relative to non-limitative embodiments and the attached drawings, wherein:

FIG. 2 is a cross-sectional view of a second embodiment of the sub-miniature fuse according to the invention.

FIG. 3 is a cross-sectional view of a sub-miniature fuse substantially corresponding to the first embodiment of FIG. 1.

FIGS. 4, 5 and 6 are side views of different types of electrodes FIG. 7 is a cross-sectional view through the electrode of FIG. 4.

FIGS. 9, 10, 11 and 12 are views of different intermediate member constructions for the embodiment of FIG. 8.

FIGS. 13 and 14 are a side view and a cross-sectional view, respectively of a sub-miniature fuse substantially produced according to the method illustrated in FIG. 8.

FIG. 15 is a view of the metal strip for forming an alternative embodiment of the intermediate member for the embodiment illustrated in FIGS. 8 to 14.

FIG. 16 is a view of an intermediate member ready to insert in the casing and based on the alternative embodiment of FIG. 15.

FIG. 17 is a view of a combined intermediate member.

DETAILED DESCRIPTION OF THE PREFERRED EMBODIMENTS

Figure 1:
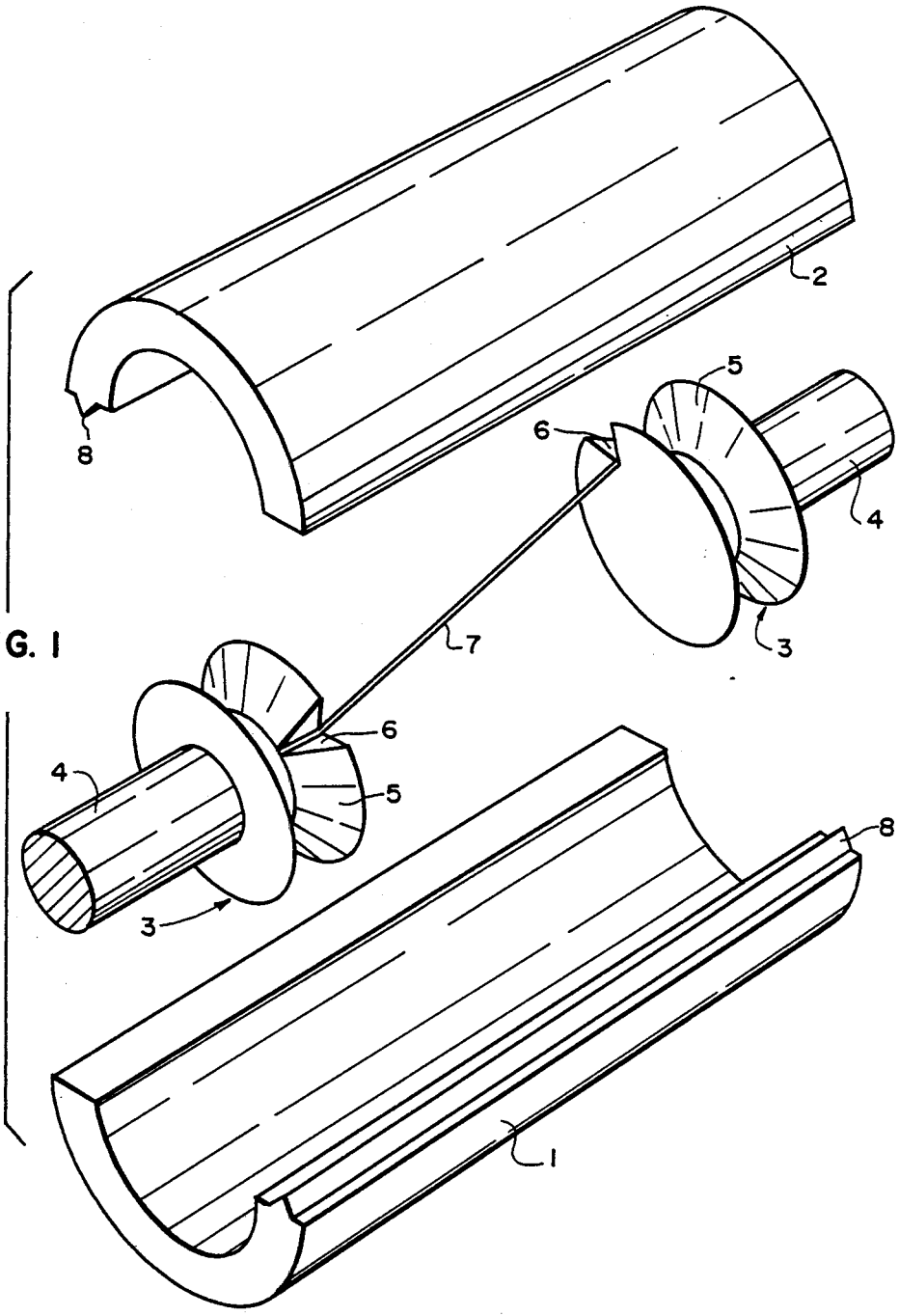
FIG. 1 is an exploded isometric view of the individual parts of a sub-miniature fuse according to a first embodiment of the invention.
Figure 8:
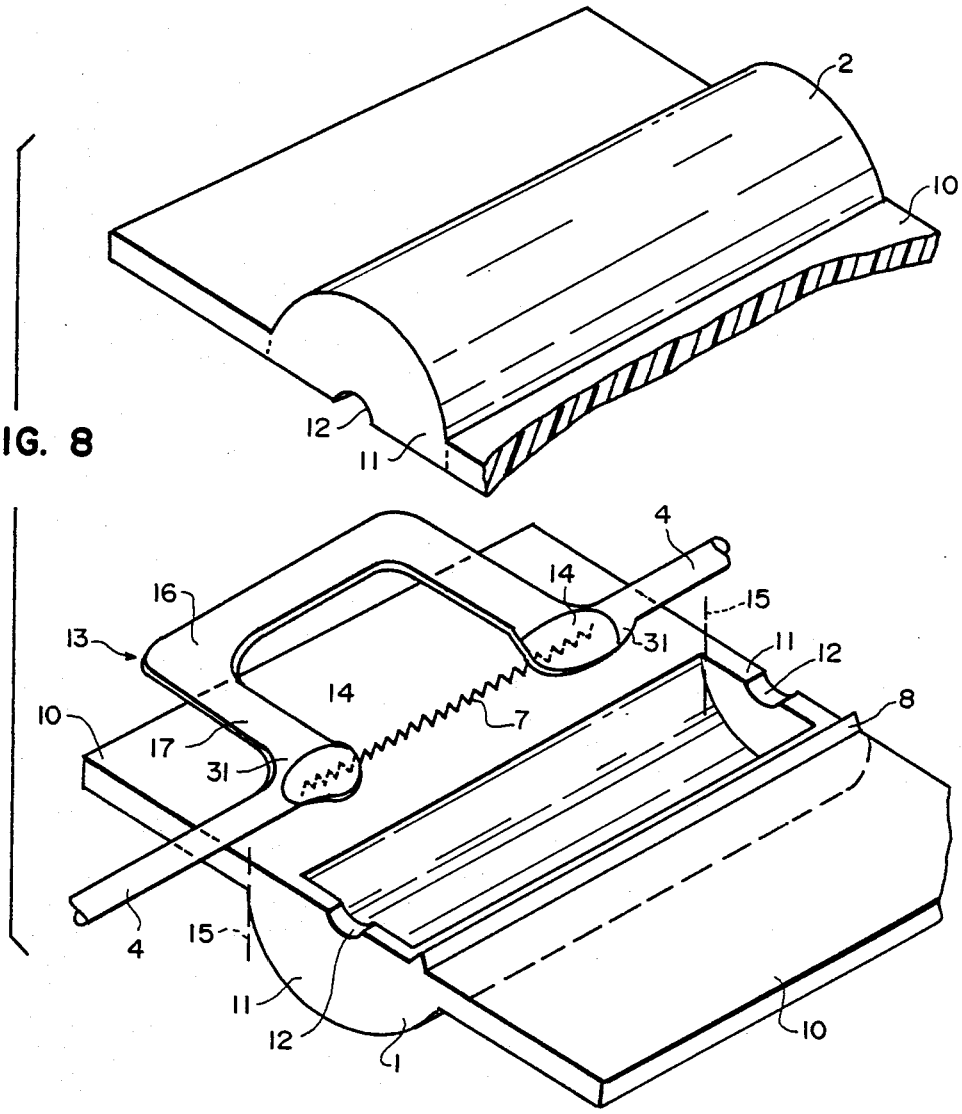
FIG. 8 is an exploded isometric view of the individual parts of a sub-miniature fuse according to a third embodiment and similar to FIG. 1.

FIG. 1 shows the individual parts of the sub-miniature fuse according to the invention. A lower casing half 1, e.g. made from a high-strength thermo-plastic material, is ready to receive the internal components. These include two electrodes 3 and a fuse wire 7, which have already been combined into an integral fuse wire-electrode unit. Following the lowering of the unit into the lower casing half 1 with the aid of a not shown device (a "lost" device is described relative to the embodiments of FIGS. 8 to 16), the second casing half 2 is placed on the lower casing half 1 in abutting relation therewith and under gentle pressure is heated along the parting lines, e.g. ultrasonically. Thus, the production of a sub-miniature fuse according to the invention is at an end.

Electrodes 3 have a special configuration for a firm union with casing halves 1 and 2. The electrode formed at the end of a connecting lead 4 by thickening carries an all-round circumferential-extending V-grove 5, which has two angular or pointed edges, whose diameter is slightly larger than the internal diameter of the casing formed through halves 1 and 2. Thus, on closing the casing, due to the heating of the corresponding casing sections, there is a slight sinking of the angular or sharp pointed edges of the electrode in the inner surfaces of the casing halves 1 and 2, so that very stable positive engagment is obtained, which gives the sub-miniature fuse overall good strength characteristics.

However, the fuse wire 7 must not be soldered to the outer edge of the electrodes, where it would be sheared off on closing casing halves 1 and 2 and instead soldering takes place further towards the center of the electrodes 3, which in the represented embodiment takes place with the aid of notches 6, which ensure an adequately central fixing of fuse wire 7. For fixing fuse wire 7 to electrodes 3, soldering paste is, e.g., coated on notches 6 and the fuse wire 7 is adhesively pressed into the paste. With the aid of an external heating source, the soldering paste is melted, so that fuse wire 7 is soldered to electrodes 3.

As a result of the respresented reciprocal rotation of the two electrodes 3 by approximately 90°, in the central area of fuse wire 7 there is a greater distance from the inner surface of the casing than in the vicinity of notches 6, which is possibly significant in connection with the holding together of the sub-miniature fuse under extreme overcurrents. The greatest spacing is achieved if the notches are arranged at 180° (cf FIG. 3). However, the reciprocal rotation of electrodes 3 should only take place when the fuse wire 7 has already been soldered, because soldering in the same plane is particularly simple.

On joining the casing halves 1 and 2 by welding, it is advantageous to have a welding lip 8, which facilitates the welding process and on welding almost completely passes into the plastic range. Diverging from the representation of casing halves 1 and 2 with a welding lip 8, it is obvious that each casing half can also have a smooth surface, if it is, e.g., intended to bond the casing halves 1 and 2 together. In this case, it is also recommended that the electrodes 3 be bonded into the casing. When an adhesive is used, virtually any material can be employed for the casing halves 1 and 2, particularly, e.g. a ceramic material or fibreglass-reinforced tube halves, which have also proved satisfactory as fuse casings.

FIGS. 2 and 3 show the shape of the sub-miniature fuse after closing the casing halves 1 and 2. Whereas in the case of the embodiment according to FIG. 2, the fuse wire 7 is soldered in the same plane between the electrodes 3 and the latter subsequently do not have to be turned with respect to one another, FIG. 3 shows and embodiment with electrodes turned 180°, so that the fuse wire 7 has a slightly diagonal course within the casing halves. The two drawings show that the slight penetration of the angular electrodes into the inner surface of casing halves 1 and 2 does not impair the adequately fused wire 7, which is adequately centrally soldered to electrodes 3.

FIGS. 4 and 7 show the electrode 3 used in the previously described embodiments. It is readily apparent that the notch 6 is only present in the portion of electrode 3 facing the fuse wire 7, so that in the direction of connecting lead 4 there is a closed, all-round, sharp edge, which completely terminates the interior of casing halves 1 and 2. The V-groove 5 present between the two portions of electrode 3 makes it possible to lower a tool into the bottom of notch 6, so that fuse wire 7, which can have a thickness down to 8 μm, can be easily fitted and firmly soldered to electrodes 3.

FIG. 5 shows an embodiment for an electrode 3', in which the fuse wire 7 is soldered to the end face of electrode 3'.

The embodiment of an electrode 3'' shown in FIG. 6 is particularly suitable for bonding into the casing and consequently for casing halves which are bonded or adhered together in the appropriate manner. Once again, the fuse wire can be soldered to the end face of electrode 3'', so that there is no risk of damage in the vicinity of the casing wall.

The two further embodiments of the invention illustrated in FIGS. 8 to 16 are largely described with respect to their differences compared with the above-described embodiments of the sub-miniature fuse and the production method for the same illustrated in the drawings, so as to avoid unnecessary repetition.

Unlike in the case of the other embodiments, the two casing halves 1, 2 have vanes 10 extending sidewards from their opening and which are concomitantly shaped on producing the casing halves. There are also semicircular end walls 11 with semicircular passages 12 for electrodes $3_1$ or their connecting leads 4. In the same way as connecting leads 4, electrodes $3_1$ are formed on a bow-shaped intermediate member 13, and the fuse wire 7 spans the bow opening and is connected by solder 14 to fixing points at the junctions of the intermediate member 13 and the connecting leads 14. In this completely prefitted state, intermediate member 13 is placed between the two casing halves 1, 2, after which the latter, together with their vanes 10 are joined together in the previously described manner. The parts projecting from the tube shape are then cut off, roughly along the broken line 15 in FIG. 8, the cut-off parts comprising the vanes 10 and the portion of the actual bow part 16 projecting outwards beyond the tube shape. Thus, as illustrated in FIGS. 13 and 14, on the two end faces there is merely and arm 17 running at right angles to the longitudinal axis of the casing and which contributes to the centering and stabilization of the fuse.

A number of possibilities exist regarding the construction of intermediate member 13 and they are represented in FIGS. 9 to 12. The cross-section of intermediate member 13 can be left round or circular throughout (FIG. 9). However, the actual bow part 16 can also be flattened, in order to give it greater stability, so as to achieve a larger and a substantially flat surface for the fixing points by solder 14 and in order to ensure easier insertion of intermediate member 13 in the vicinity of vanes 10. The circular cross-section of connecting lead 4 or the correspondingly shaped start of electrodes $3_1$ suitable for centering purposes in the longitudinal direction of the casing is retained (FIG. 10). Instead of flattening the complete bow, according to FIG. 11, this can be limited to the corner areas of the bow and the outwardly extending arm 17. A completely flattened construction of intermediate member 13 according to FIG. 12 is particularly stable. For the purpose of clearly defined fixing in this case, a through-opening must be provided on end walls 11 having a cross-section adapted thereto.

A modified embodiment of the bow is shown in FIGS. 15 and 16. Initially, a ladder-shaped metal strip 18 is stamped out and over it is guided a fuse wire filament 19 and is fixed by means of solder 20 to the rungs 21 of metal strip 18. The intermediate member 13' is then continuously separated from metal strip 18 along the rungs 21 or the broken lines 22. After soldering both ends of the fuse wire 7 to the connecting leads 4 acting as electrodes $3_2$, the intermediate member 13' is fixed between the casing halves 1, 2 provided with vanes 10 in the same way as the previously described intermediate member 13 (cf FIG. 8). Then, once again the vanes 10 are separated from the tubular casing and simultaneously the actual bow parts 16' projecting on either side are also cut off roughly along broken line 23. Thus, the two electrodes according to FIGS. 9 to 14 on the one hand and FIGS. 15 and 16 on the other essentially only differ through the different shape and production procedure for intermediate member 13.

In the case of the third embodiment of the intermediate member 13" shown in FIG. 17, it is in fact a mixed or combined form, comprising an intermediate member 13 and an intermediate member 13' placed thereon and electrically conductively fixed and preferably welded thereto. Prior to the separation from metal strip 18, fuse wire 7 is fixed in the aforementioned manner to intermediate member 13' and connecting leads or contacts 4 extend to either side of intermediate member 13 as from the shaping thereof from a metal wire portion. After introducing the intermediate member 13" into the not shown two casing halves 1 and 2, the not shown vanes 10 and the projecting bwo parts 16,16' are also cut off in the case of the sub-miniature fuse type produced in this way. Arms 17 remain in the sub-miniature fuse and on each of the two fuse ends extends approximately radially to either side, namely always to one side as a pair of metal wire portions with a sheet metal portion fixed thereto. This embodiment has a particularly good stability and adequate centrability and obviates the need for separately soldering the connecting leads or electrodes 4 to the intermediate member as in the case shown in FIG. 16, because the intermediate member 13 is formed as an integral structure with the connecting leads 4.

What is claimed is:

1. A method for the production of a sub-miniature fuse, in which after determining the distance between two electrodes, a fuse wire is electrically conductively fixed therebetween and then an initially two-part insulating material casing surrounding the electrodes and the fuse wire is closed, wherein the casing is formed with a substantially smooth surface on the inside, the fuse wire is fixed between the spaced electrodes by electrically conductively fixing both ends of the fuse wire to an intermedite member such that the fuse wire spans two spaced-apart sections of the intermediate member to which are electrically fixed respective ones of the electrodes, the intermediate member including the fuse wire and electrodes fixed thereto is placed between the casing halves with the electrodes projecting outwardly from opposite ends thereof, the casing is closed, and the intermediate member is severed along the two sections thereof so that the fuse wire comprises the only electrically conductive path between the two electrodes.

2. A method according to claim 1, wherein on either side of the casing halves, vanes project approximately parallel to an imaginary plane of division of the casing halves and after closing the casing said vanes are cut off from the casing, together with the intermediate member parts located between th vanes, outside the casing.

3. A method according to claims 1 or 2, wherein for producing the intermediate member, a metal strip in the form of a ladder is formed, to whose rungs is electrically conductively fixed a fuse wire filament extending at right angles relative to the rungs, and then the intermediate member is separated from the metal strip along two of the rungs and the electrodes are electrically fixed to the two separated rungs.

4. A method according to claims 1 or 2, wherein the intermediate member, together with the electrodes, is formed from one piece of metal wire.

5. A method according to claim 4, wherein the intermediate member comprises a wholly or partly flattened member.

6. A method according to claims 1 or 2, wherein the casing halves are closed at the ends and provided with a recess for the passage of the electrodes.

7. A method according to claim 1 wherein the closure of the casing is brought about by adhesion or welding.

8. A method according to claim 1, wherein the casing is formed from two substantially identical tube halves.

9. A method according to claim 3, wherein the intermediate member separated from a substantially ladder-shaped metal strip after fixing a fuse wire filament thereto is electrically conductively fixed to a second, substantially bow-shaped, metal wire intermediate member whose ends form the electrodes in order to constitute a combined intermediate member.

10. A sub-miniature fuse comprising: a two-part casing with a pre-assembled fuse wire-electrode unit held therein, the pre-assembled fuse wire-electrode unit comprising a pair of spaced-apart electrodes extending generally lengthwise of the casing and projecting out from opposite ends of the casing and a fuse wire spanning the spaced-apart electrodes and integrally fixed thereto, each electrode having an arm portion extending generally transversely of the casing in between the two parts of the casings, and wherein the casing is tubular and has a substantially smooth surface throughout on its inside.

11. A method for producing a fuse, comprising the steps of: electrically fixing a fuse wire to a pair of spaced-apart electrodes without winding the fuse wire around a core to form an integral pre-assembled fuse wire-electrode unit, the electrically fixing step comprising providing a pair of spaced-apart electrodes rigidly interconnected through an intermediate frame member, and electrically fixing a fuse wire to the opposed end portions of the two electrodes to form an integral fuse wire-electrode unit; providing a casing comprised of a pair of relatively movable casing sections composed of electrically insulating material, the providing a casing step including providing two casing sections each having at least one radially extending vane which projects radially outwardly from the outside of the casing section; interposing the fuse wire-electrode unit between the casing sections and abutting the casing sections against one another to close the casing such that the electrodes project outwardly from opposite ends of the casing and the fuse wire extends lengthwise inside of the casing, the interposing and abutting steps including positioning the fuse wire-electrode unit on one casing section with the intermediate frame member lying on the casing section vane, and positioning the other casing section in abutting relation with the one casing section so that the vanes of the two casing sections sandwich the intermediate frame member therebetween; securing together the abutting casing sections; and severing the vanes from the two casing sections and at the same time severing the intermediate frame member from the two electrodes.

12. A method for producing a fuse, comprising the steps of: providing a pair of spaced-apart electrodes having radially extending pointed edges; electrically fixing a fuse wire to the pair of spaced-apart electrodes without winding the fuse wire around a core to form an integral pre-assembled fuse wire-electrode unit; providing a casing comprised of a pair of relatively movable casing sections composed of electrically insulating material; interposing the fuse wire-electrode unit between the casing sections and abutting the casing sections against one another to close the casing such that the electrodes project outwardly from opposite ends of the casing and the fuse wire extends lengthwise inside of the casing, the interposing and abutting steps including closing the casing sections over the fuse wire-electrode unit and pressing the casing sections together to embed the electrode pointed edges in the casing sections; and securing together the abutting casing sections.

* * * * *